United States Patent [19]

Maurer et al.

[11] Patent Number: 4,643,631

[45] Date of Patent: Feb. 17, 1987

[54] QUICK COUPLING AND RELEASE MECHANISM FOR BUCKETS

[75] Inventors: Herman J. Maurer, Columbus, Ind.; John F. Shumaker, Mt. Pleasant, Iowa

[73] Assignee: J. I. Case Company, Racine, Wis.

[21] Appl. No.: 725,858

[22] Filed: Apr. 22, 1985

[51] Int. Cl.[4] ..... E02F 3/70

[52] U.S. Cl. ..... 414/723; 172/272

[58] Field of Search ..... 414/721–724; 172/272–275

[56] References Cited

U.S. PATENT DOCUMENTS

| | | | |
|---|---|---|---|
| 4,127,203 | 11/1978 | Arnold | 414/723 |
| 4,373,852 | 2/1983 | Maurer | 414/723 |
| 4,436,477 | 3/1984 | Lenertz et al. | 414/723 |

*Primary Examiner*—Frank E. Werner

*Attorney, Agent, or Firm*—Cullen, Sloman, Cantor, Grauer, Scott & Rutherford

[57] ABSTRACT

A quick coupling and release mechanism for attaching a material handling bucket to the free end of a scoop arm extending from a loader or backhoe. The quick coupler has three spaced apart ends including a first end connected to a push-pull link by a releasable pin, a second end pivotally mounted between bifurcated ends on the loader arm, and a third end which is slotted for selective engagement with a mounting pin on the bucket. The push-pull link may be connected at a first location to the quick coupler when it is desired to permit more angular displacement of the quick coupler or to a second location on the quick coupler when it is desired to permit less angular displacement of the quick coupler. Further, the quick coupler and bucket are pivotally connected to the loader arm by a single releasable pin for pivotal movement about a common pivot axis. A single operator can easily handle the entire coupling or uncoupling operation without special tools. Further, the quick coupler does not require a special bucket construction or the attachment of special parts to the bucket for its operability.

1 Claim, 4 Drawing Figures

QUICK COUPLING AND RELEASE MECHANISM FOR BUCKETS

BACKGROUND OF THE INVENTION

The present invention relates to an apparatus for attaching implements to the free end of a tractor loader boom and, more particularly, to an improved and simplified quick attachment and release device for attaching buckets or the like to a loader or backhoe scoop arm.

It is known to provide backhoes or similar types of earth-working machines with different sizes and types of material handling implements or buckets to perform numerous working operations. Changing from one bucket to another is a problem because of the time and labor expended in the changeover. The buckets are heavy and awkward to manipulate and many times special tools are required to make the changeover. It is, therefore, an object of this invention to provide a quick attaching and release mechanism for easily coupling and releasing different buckets to the same loader boom structure.

In prior art backhoes, the buckets are typically pinned to the actuating arms of the loader scoop arm during periods of use. Since the buckets are heavy items, a great deal of time and effort is required to attach the bucket or release the bucket from the scoop arm for repairs to the bucket or the actuating arms. Further, after a period of use, dirt and corrosion often render removal of the bucket from the loader arm quite difficult. The prior art semiautomatic devices for attaching and releasing implements on loaders have eliminated many of the problems associated with the use of pins. However, due to the design of such prior art devices, fatigue and fracture continue to be a problem and dirt often causes the complex operative elements of the attachment and release devices to become jammed.

These disadvantages of present quick attaching mechanisms have resulted in the present quick coupling device for attaching a material handling implement or bucket to a loader's boom structure.

SUMMARY OF THE INVENTION

In accordance with the present invention, the improved attachment and release mechanism permits various buckets to be used with the same scoop arm, and it permits a bucket to be attached or released from the scoop arm in a minimum of time and with a minimum of effort.

The prior U.S. patents to Baker et al, No. 4,225,283, and Maurer, No. 4,373,852, assigned to the assignee of the present invention, disclose quick coupling mechanisms that permit a bucket to be conveniently attached or released from the scoop arm. The present invention provides an improvement over those mechanisms by utilizing a simpler construction which is operable with one operator using a minimum amount of physical exertion.

It is an object of the present invention to provide a quick coupling bucket mounting mechanism which is pivotally connected to the end of a loader scoop arm for readily receiving various types and sizes of buckets. The quick coupling mechanism has three spaced apart ends including a first end connected to a push-pull link by a releasable pin, a second end pivotally mounted between bifurcated ends on the loader arm, and a third end which is slotted for selective engagement with a mounting pin on the bucket. The push-pull link may be connected to a first pair of openings in the quick coupler when it is desired to permit more angular displacement of the quick coupler or to a second pair of openings in the quick coupler when it is desired to permit less angular displacement of the quick coupler. Further, the quick coupler and bucket are pivotally connected to the loader arm by a single releasable pin for pivotal movement about a common pivot axis. This common pivot axis permits the bucket to be quickly attached to the loader arm without altering the bucket and without increasing the distance from the loader arm attaching point to the bucket cutting edge.

The quick coupling mechanism is attachable to a bucket that is sitting up or to a bucket having its open side down. Initially, the operator maneuvers the quick coupling mechanism to capture the mounting pin on the bucket within the slotted end of the coupler. Next, the loader arm is raised to a position where the bucket hangs freely for swinging movement. Then, the push-pull link is operated to align the opening through the mounting bushing for the quick coupler with the attachment points on the bucket. Thereafter, the bucket is easily rocked by hand for any final adjustment and a releasable mounting pin is inserted thereby connecting the bucket and loader scoop arm.

The bucket is uncoupled from the loader arm by going through the steps just described in reverse. First, the operator releases the pin at the loader arm so that the bucket assumes a free hanging position. The loader arm is lowered to place the bucket on the ground and the push-pull link is actuated to pivot the quick coupler for releasing the slotted end on the coupler from the permanent mounting pin on the bucket.

Thus, the present quick coupler mechanism provides several advantages over prior constructions. The quick coupler and bucket are connected to the loader arm for pivotal movement about a common axis thereby providing a compact construction. Further, the push-pull link may be connected to the quick coupler at various locations for changing the angular displacement of the coupler thereby resulting in a corresponding change in the bucket cutting edge force. Therefore, the coupler is compact, easy to manufacture, and reliable in operation in various environments. A single operator can easily handle the entire coupling or uncoupling operation without special tools. Further, the quick coupler does not require a special bucket construction or the attachment of special parts to the bucket for its operability.

Other advantages and meritorious features of the quick attachment and release construction of the present invention will be more fully understood from the following description of the invention, the appended claims and the drawings, a brief description of which follows.

DETAILED DESCRIPTION OF THE INVENTION

Figure 1:
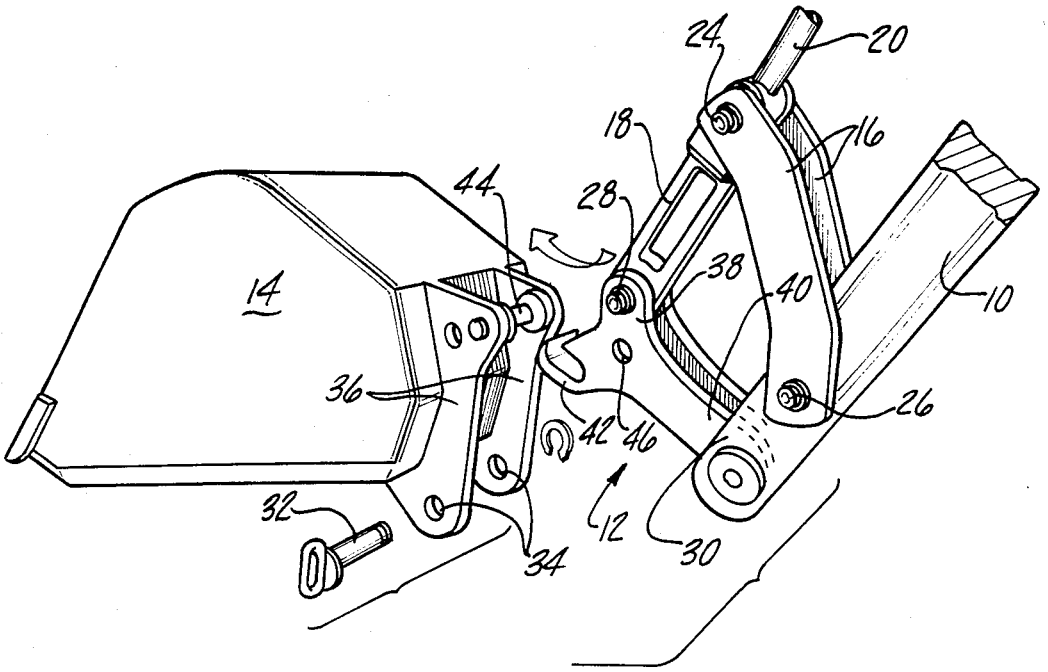
FIG. 1 is a perspective view of the quick coupler of the present invention unconnected from a bucket.

A tractor mounted backhoe having an extensible dipper stick 10 and quick coupling mechanism 12, according to the present invention, is illustrated in FIGS. 1–4. The backhoe assembly includes a rearwardly projecting boom (not shown) to which is connected the dipper stick 10 in a conventional manner. A bucket assembly 14 is pivotally attached to the end of the dipper stick 10 by the quick attachment and release device 12 of the present invention.

The bucket mounting linkage includes opposed links 16, a push-pull link 18, and quick coupler 12 for readily attaching various types and sizes of buckets. Piston rod 20 of a hydraulic actuated cylinder 22 is attached at its extensible rod end to links 16 and 18 by pin 24. Extension and retraction of hydraulic cylinder 22 causes the coupled bucket assembly 14 to pivot toward and away from dipper stick 10 thereby permitting the backhoe bucket to dig or dump.

Links 16 are pivotally attached to dipper stick 10 by pin 26, and push-pull link 18 is pivotally attached to quick coupler 12 by a releasable pin 28. Further, quick coupler 12 is pivotally mounted between the bifurcated ends 30 of dipper stick 10 by a bushing (not shown). A releasable pin 32 passes through aligned openings 34 in bucket mounting brackets 36 and through the mounting bushing (not shown) for coupler 12 for pivotally mounting bucket assembly 14 to the end of dipper stick 10. Thus, bucket assembly 14 and quick coupler 12 are pivotally attached to dipper stick 10 for pivotal movement about a common pivot axis.

The quick coupler 12 has three spaced apart ends including a first end 38 connected to push-pull link 18 by releasable pin 28, a second end 40 pivotally connected between the bifurcated ends 30 of dipper stick 10, and a third end 42 which is slotted for selective engagement with a mounting pin 44 on bucket assembly 14. As described, push-pull link 18 is connected at one end to quick coupler 12 by releasable pin 28. This connection is made either to a first pair of openings in end 38 as shown in FIGS. 1–4, or to a second pair of openings 46 in end 38. One of the pairs of openings in end 38 are located so as to permit more angular displacement of the quick coupler 12 with a consequential reduction of bucket cutting edge force while the other pair of openings permits less angular displacement of the quick coupler with more cutting end force.

Quick coupler 12 and bucket assembly 14 are connected to dipper stick 10 for pivotal movement about a common pivot axis. This common pivot axis permits bucket 14 to be quickly attached to dipper stick 10 without altering the bucket and without increasing the distance from the dipper stick attaching point to the bucket cutting edge.

Figure 2:
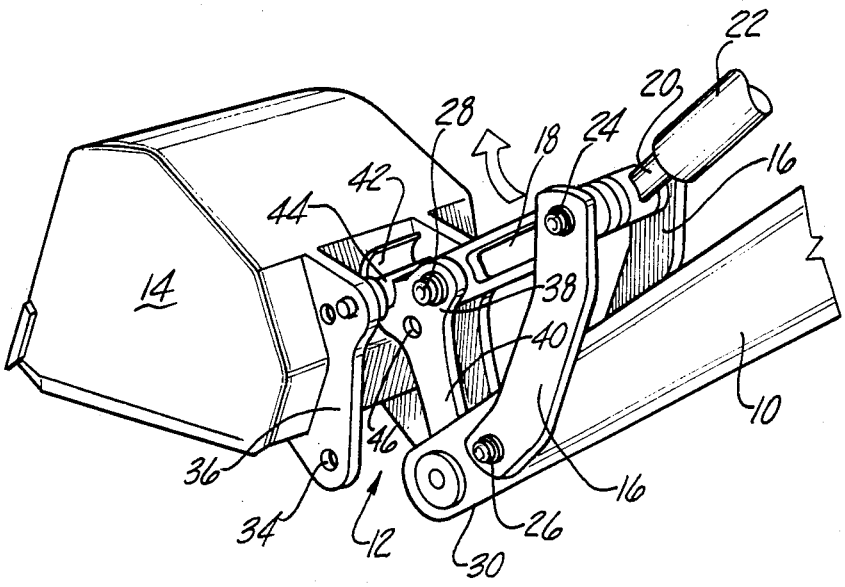
FIG. 2 is a perspective view of the quick coupler partially connected to the bucket.
Figure 3:
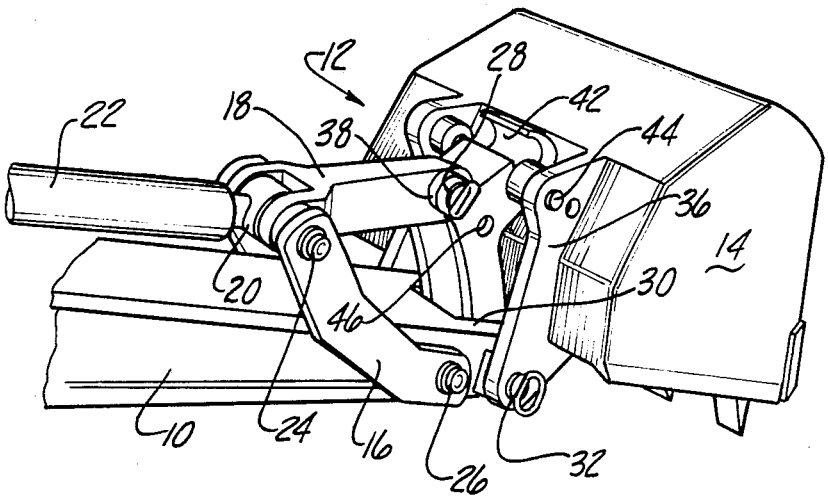
FIG. 3 is a perspective view of the quick coupler and bucket fully connected.
Figure 4:
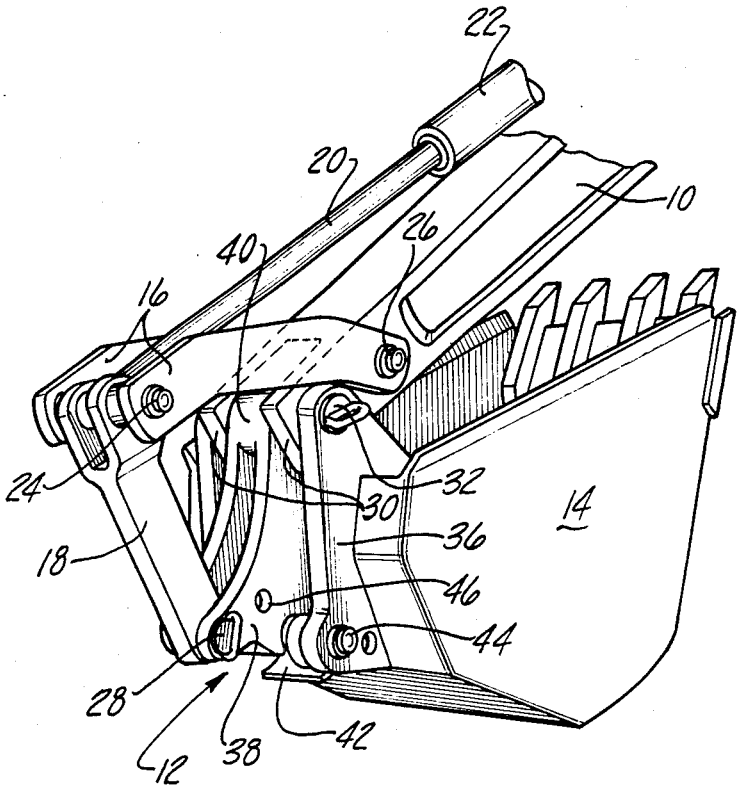
FIG. 4 is a perspective view of the coupled connection in another operating position.

The quick coupling mechanism 12 is attachable to a bucket assembly 14 that is sitting up or to a bucket having its open side down as illustrated in FIG. 1. Referring to FIG. 1, the operator initially maneuvers the quick coupling mechanism 12 to capture the bucket mounting pin 44 within the slotted end 42 of the coupler as shown in FIG. 2. Next, piston cylinder 22 is retracted and dipper stick 10 is raised to align the opening through quick coupler end 40 with the attachment points 34 on bucket 14. Thereafter, releasable mounting pin 32 is inserted through the aligned bucket attaching points 34 and coupler opening thereby completing the connection between bucket 14 and dipper stick 10. Bucket 14 is uncoupled from loader arm 10 by going through the steps just described in reverse.

Thus, the present quick coupler mechanism 12 provides several advantages over prior constructions. Coupler 12 is compact, easy to manufacture, and reliable in operation in various environments. A single operator can easily handle the entire coupling or uncoupling operation without special tools. Further, quick coupler 12 does not require a special bucket construction or the attachment of special parts to the bucket for its operability.

It will be apparent to those skilled in the art that the foregoing disclosure is exemplary in nature rather than limiting, the invention being limited only by the appended claims.

We claim:

1. A quick attachment and release mechanism for attaching a bucket to a loader scoop arm having at least one extensible and retractable push-pull link operatively attached thereto, said mechanism comprising:

a quick coupler pivotally mounted to said loader arm for receiving various types and sizes of buckets, said quick coupler including a first end pivotally mounted between bifurcated ends on said loader arm by a first releasable mounting pin, a second end which is slotted for selective engagement with a mounting pin on said bucket, and a third end spaced from said slotted end and pivotally connected to, one end of said push-pull link by a second releasable mounting pin, said bucket and said quick coupler first end connected to said loader arm by said first releasable mounting pin for pivotal movement about a common pivot axis, the opposite end of said push-pull link connected by a first pivot pin to one end of a pivot link and the opposite end of said pivot link connected by a second pivot pin to said loader arm, said first releasable mounting pin spaced from said second pivot pin along said loader arm and said second releasable mounting pin spaced from said first pivot pin such that a generally four-bar linkage is formed between said quick coupler, said push-pull link, said pivot link and the portion of said loader arm between said first releasable mounting pin and said second pivot pin; and said quick coupler third end including at least two attaching points for said push-pull link whereby said push-pull link being connected to one of said attaching points when it is desired to permit more angular displacement of said quick coupler or said push-pull link being connected to the other attaching point when it is desired to permit less angular displacement of said quick coupler.

* * * * *